US005351921A

United States Patent [19]

Chen

[11] Patent Number: 5,351,921

[45] Date of Patent: Oct. 4, 1994

[54] GOLF BAG FOLDING STAND

[76] Inventor: Chen-Tung Chen, No. 631, Sec. 1, Chung Shan Rd., Ta Chia Chen, Taichung Hsien, Taiwan

[21] Appl. No.: 72,010

[22] Filed: Jun. 7, 1993

[51] Int. Cl.[5] ..... A63B 55/00

[52] U.S. Cl. ..... 248/96; 248/688; 206/315.7

[58] Field of Search ..... 248/96, 136, 688, 293, 248/284; 206/315.7, 315.2, 315.3

[56] References Cited

U.S. PATENT DOCUMENTS

| | | | |
|---|---|---|---|
| 1,970,849 | 8/1934 | Gunther | 248/96 |
| 4,506,854 | 3/1985 | Kim | 248/96 |
| 4,620,682 | 11/1986 | Yim | 248/96 |
| 5,036,974 | 8/1991 | Ross, Jr. | 248/96 X |
| 5,042,654 | 8/1991 | Jones | 248/96 X |
| 5,147,089 | 9/1992 | Anderson | 248/96 |
| 5,152,483 | 10/1992 | Maeng | 206/315.7 X |
| 5,154,377 | 10/1992 | Suk | 248/96 |
| 5,156,366 | 10/1992 | Anderson | 248/96 |
| 5,236,085 | 8/1993 | Quellais | 248/96 X |

*Primary Examiner*—Karen J. Chotkowski
*Attorney, Agent, or Firm*—Browdy and Neimark

[57] ABSTRACT

The invention is directed to a golf bag folding stand which has two legs pivotably fastened to a golf bag by a mount. A hinge device is fastened to the golf bag at the bottom and two connectors respectively fastened around the legs and joined by an elastic band. A spring link is connected between the connectors and a hinged movable plate on the hinge device, whereby the spring link pushes the hinged movable plate downward for allowing the legs to be automatically received to the golf bag when the golf bag is lifted from the ground. The hinged movable plate is forced to push the spring link upward as the golf bag is placed on the ground with the hinged movable plate stopped against the ground, causing the spring link to extend the legs apart from each other and simultaneously to push the legs away from the golf bag.

5 Claims, 5 Drawing Sheets

FIG. 3
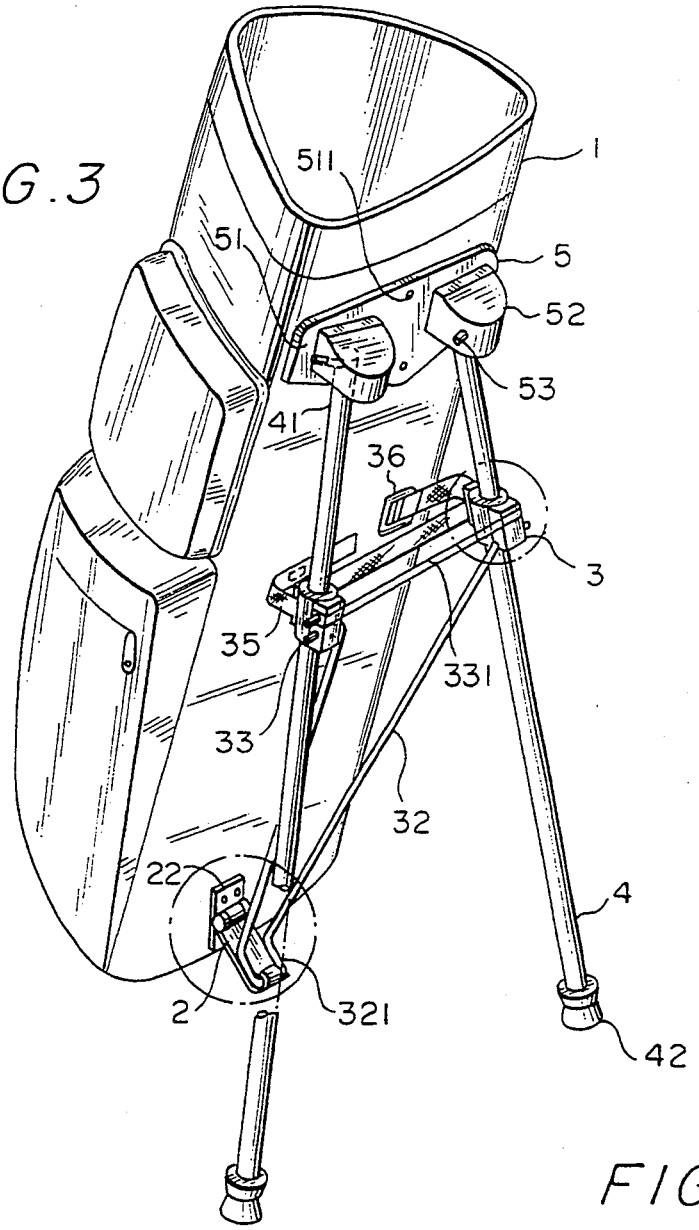
FIG. 3A
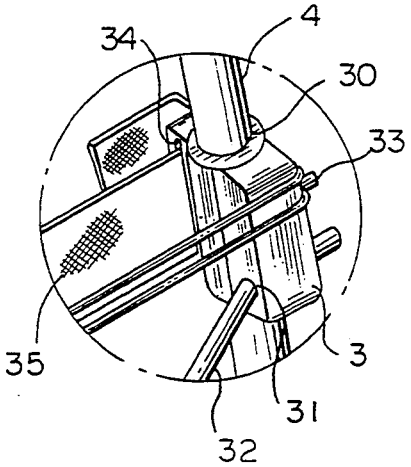
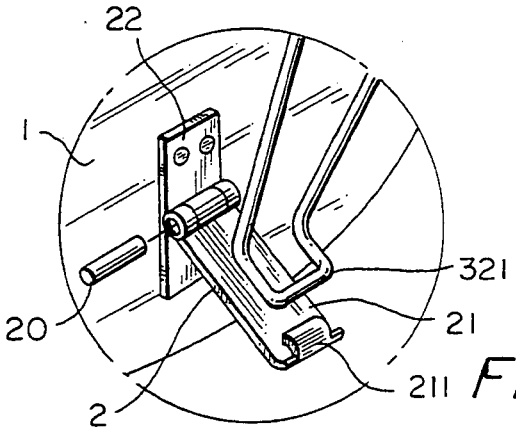
FIG. 4

FIG. 5A
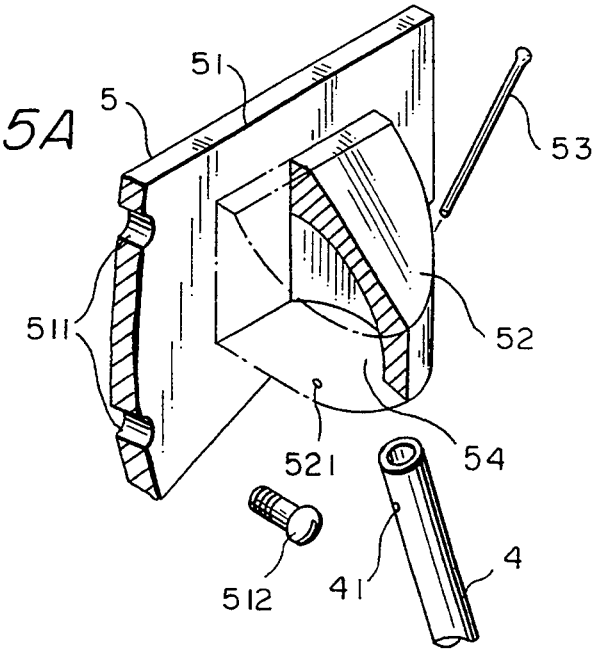
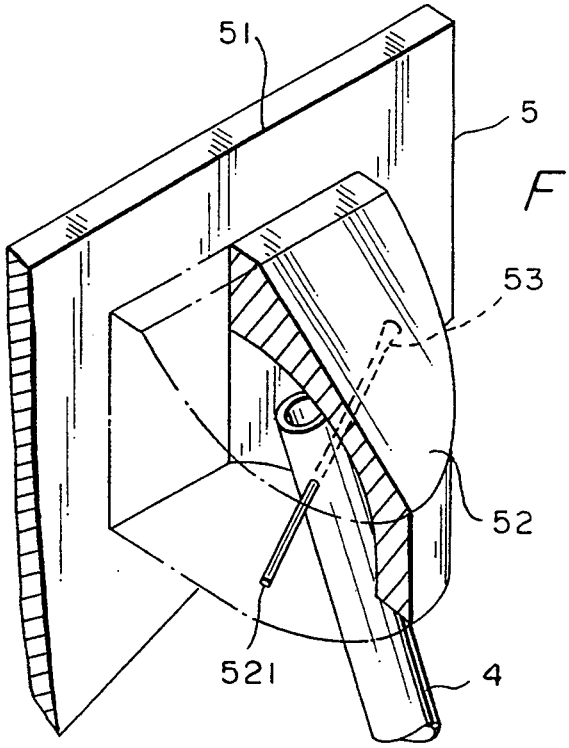
FIG. 5B
FIG. 6
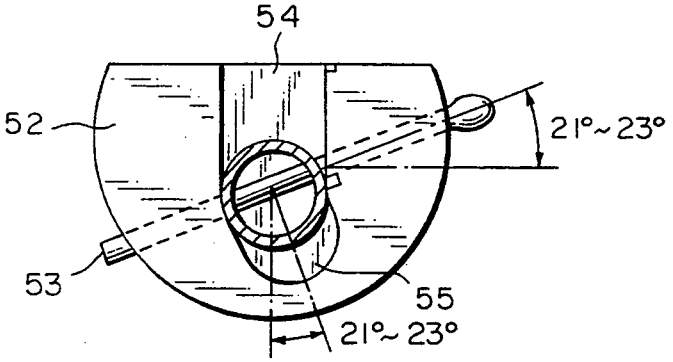

GOLF BAG FOLDING STAND

BACKGROUND OF THE INVENTION

The present invention relates to a golf bag stand fastened to a golf bag for supporting it on the ground.

A variety of golf bags are manufactured and used for carrying different golf clubs, golf balls, and umbrellas. When a full set of golf clubs are carried in a golf bag, the golf bag does not stand up as it is placed on the ground. Therefore, the golf bag must be carried over the shoulder all the time. Various folding stands have been disclosed for use with golf bags.

FIG. 1 illustrates a golf bag folding stand fastened to a golf bag for supporting it on the ground, which comprises a mounting plate fastened to the golf bag on the outside near the top cuff thereof, two legs respectively and pivotably connected to two horizontally spaced lugs by pivots, two connecting frames respectively fastened to the legs in the middle, and two elastic bands respectively connected between the connecting frames on the legs and respective pins on the mounting plate. Because the golf bag is simply supported by the two legs, it may fall to the ground easily.

FIG. 2 illustrates another structure of folding stand fastened to a golf bag for supporting it on the ground, which comprises a mounting plate fastened to the golf bag on the outside near the top cuff thereof, two legs respectively and pivotably connected to the mounting plate, two connecting frames respectively fastened to the legs in the middle, an elastic bang having one end fastened to either connecting frame and an opposite end inserted through a ring on the mounting plate and then fastened to the other connecting frame, and a slide fastener movably fastened around the elastic band. This structure of folding stand is similar to the folding stand shown in FIG. 1, and can not eliminate the aforesaid problem.

SUMMARY OF THE INVENTION

One object of the present invention is to provide a golf bag folding stand which can be automatically extended out to support the gold bag stably in a sloping position as the golf bag is placed on the ground. It is another object of the present invention to provide a golf bag folding stand which will be automatically folded up and received to the golf bag as the golf bag is lifted from the ground. It is still another object of the present invention to provide a golf bag folding stand which is suitable for any of a variety of golf bags. According to the preferred embodiment of the present invention, the mount which holds the legs to the golf bag has two sockets. Each socket has a bevel through hole fastened with a pivot, on which the respective leg is pivoted within 23° to 25° angle along the X-axis, and a guide track to guide the respective leg within 55° angle along the Y-axis. A spring link is connected between the legs and a hinged movable plate being hinged to the golf bag near the bottom cuff thereof. The spring link pushes the hinged movable plate downward for allowing the legs to be automatically received to the golf bag as the golf bag is lifted from the ground; the hinged movable plate is forced to push the spring link upward as the golf bag is placed on the ground with the hinged movable plate stopped against the ground, causing the spring link to extend the legs apart from each other and simultaneously to push the legs away from the golf bag.

BRIEF DESCRIPTION OF THE DRAWINGS

FIG. 3 is an elevational view of a golf bag with a folding stand according to the present invention;

FIG. 3A is a partial enlarged view of the positioning device shown in FIG. 3;

FIG. 4 is a partial enlarged view of the hinge device and the middle bend of the spring link of the folding stand shown in FIG. 3;

FIG. 5A is a partial perspective dismantled view of the mount the folding stand shown in FIG. 3;

FIG. 5B is a partial perspective assembly view of the mount of the folding stand shown in FIG. 3;

FIG. 6 is a top plan view of the socket of the mount of the folding stand shown in FIG. 3, showing the oscillation angle of the leg in the socket along the X-axis as well as the Y-axis;

DETAILED DESCRIPTION OF THE PREFERRED EMBODIMENT

Figure 2:
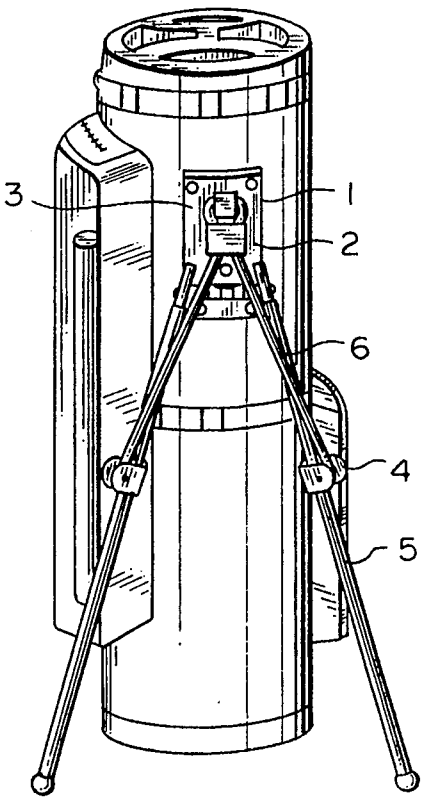
FIG. 2 (PRIOR ART)
FIG. 2 is an elevational view of another golf bag with a different structure of folding stand according to the prior art.
Figure 1:
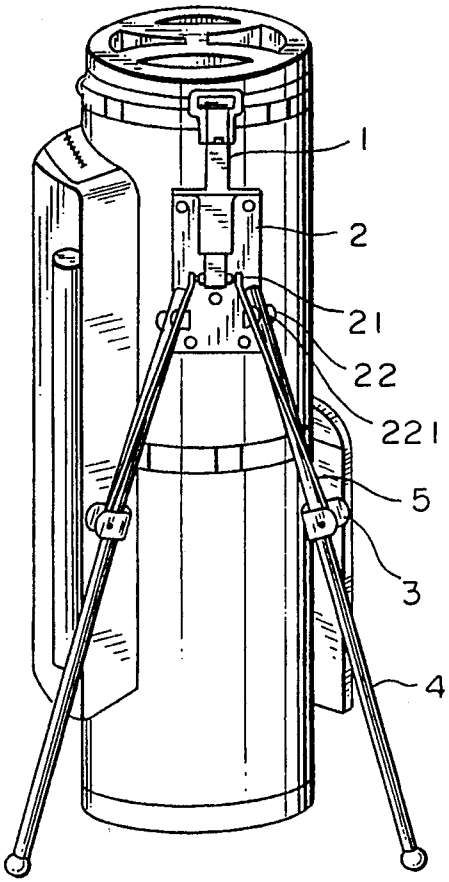
FIG. 1 (PRIOR ART)
FIG. 1 is an elevational view of a golf bag with a folding stand according to the prior art.

Referring to FIGS. 3, 3A, 4, 5A, 5B and 6, a golf bag stand in accordance with the present invention is generally comprised of two legs 4, a mount 5 fastened to a golf bag 1 near its top cuff to hold the two legs 4, a hinge device 2 fastened to the golf bag 1 near its bottom cuff, and a positioning device connected between the legs 4 and the hinge device 2.

The hinge device 2 comprises a mounting plate 22 fastened to the golf bag 1, and a hinged movable plate 21 hinged to the mounting plate 22 by a pivot pin 20. The hinged movable plate 21 of the hinge device 2 is terminated to a hooked portion 211 hooked on the positioning device.

The positioning device comprises two connectors 3 respectively mounted around the legs 4, a spring link 32 connected between the connectors 3 and the hinge device 2, a strap 35 connected between the golf bag 1 and the connectors 3, and an elastic loop 331 fastened between the connectors 3. The connectors 3 are symmetrical, each comprising a longitudinal center through hole 30, which receives either leg 4, a small transverse side through hole 31 and a side slot 34 on two opposite sides by the center through hole 30, and a stub rod 33 near the side through hole 31. The strap 35 has one end fastened to the golf bag 1 by stitches, and an opposite end respectively inserted through the side slot 34 on each connector 3 and then fastened to the golf bag 1 by a belt buckle 36. The elastic loop 331 is mounted around the stub rod 33 on each connector 3. The spring link 32 is made in a substantially V-shaped configuration having a bend 321 in the middle hooked by the hooked portion 211 of the hinged movable plate 21 of the hinge device 2 and two opposite ends respectively bent outward and inserted into the side through hole 31 on either connector 3 from a respective inner side (i.e., the spring link 32 is retained between the legs 4).

The legs 4 are identical and respectively inserted through the center through hole 30 on either connector 3, each having a bevel pin hole 41 near the respective top end respectively connected to the mount 5 and a cushion 42 covered on the respective bottom end.

The mount 5 comprises a mounting board 51 having two vertically spaced through holes 511 in the middle respectively fastened to the golf bag 1 by screws 512, and two sockets 52 bilaterally projected from the mounting board 51 to hold the legs 4. As shown in FIGS. 5A and 5B, each socket 52 comprises a bevel through hole 521, a pivot pin 53 inserted through the bevel through hole 521 on the respective socket 52 and the bevel through hole 41 on the respective leg 4 to connect the respective leg 4 to the respective socket 52, a guide track 54 on the inside to guide the respective leg 4. The bevel through hole 521 allows the respective leg 4 to be oscillated around the respective pivot pin 53 within 21° to 23° angle along the X-axis; the guide track 54 allows the respective leg 4 to be moved within 55° angle along the Y-axis (see FIG. 6).

Figure 7:
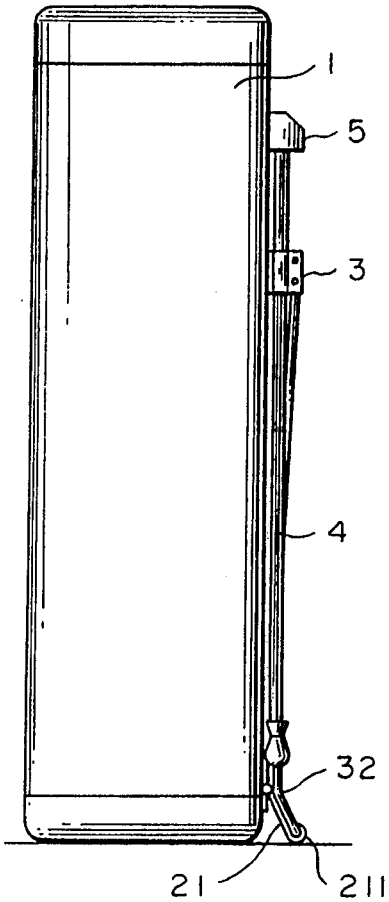
FIG. 7 is a side view of the golf bag shown in FIG. 3, when the folding stand is collapsed.

Referring to FIG. 7, the stand is folded up and closely attached to the golf bag 1 when it is not in use.

Figure 8:
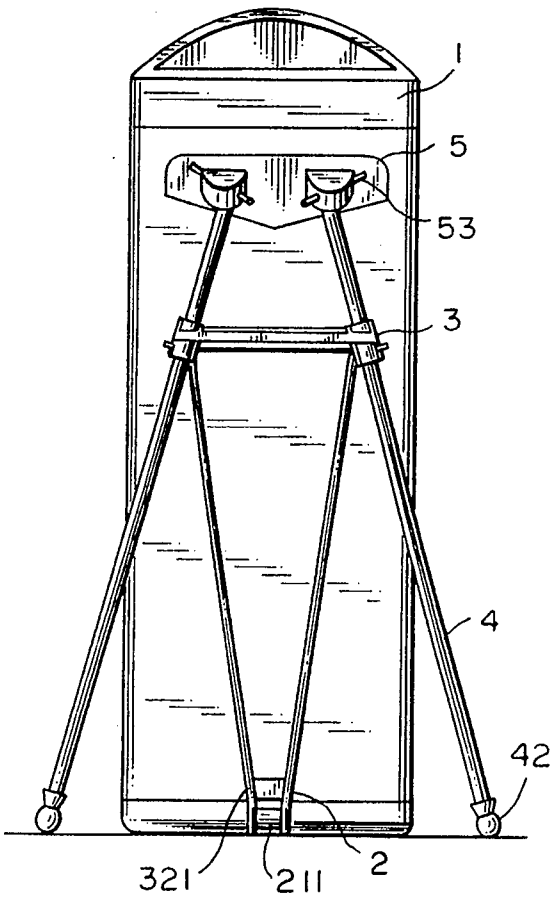
FIG. 8 is a front plan view of the golf bag shown in FIG. 3 when the folding stand extended out to support the golf bag in a sloping position.
Figure 9:
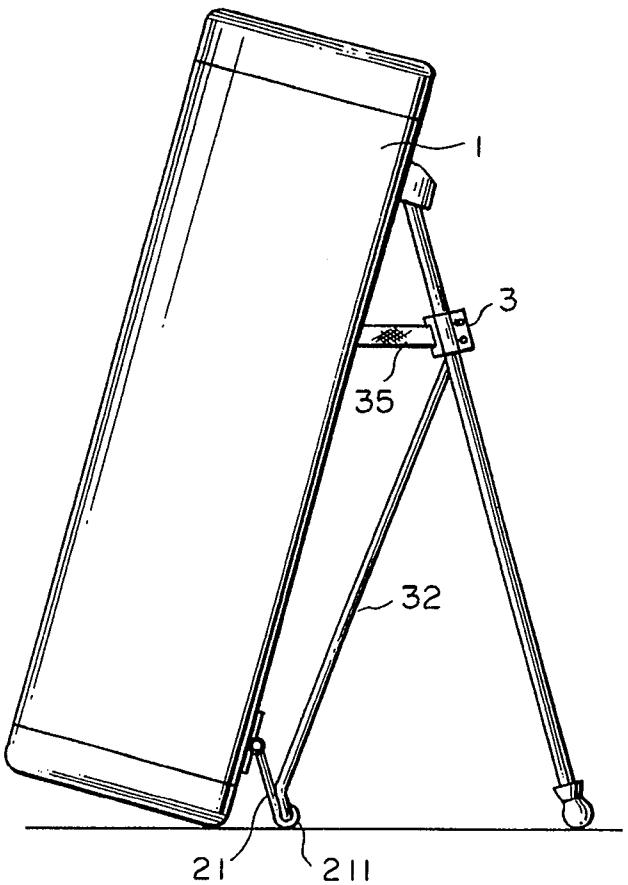
FIG. 9 is a side view taken of FIG. 8.
Figure 10:
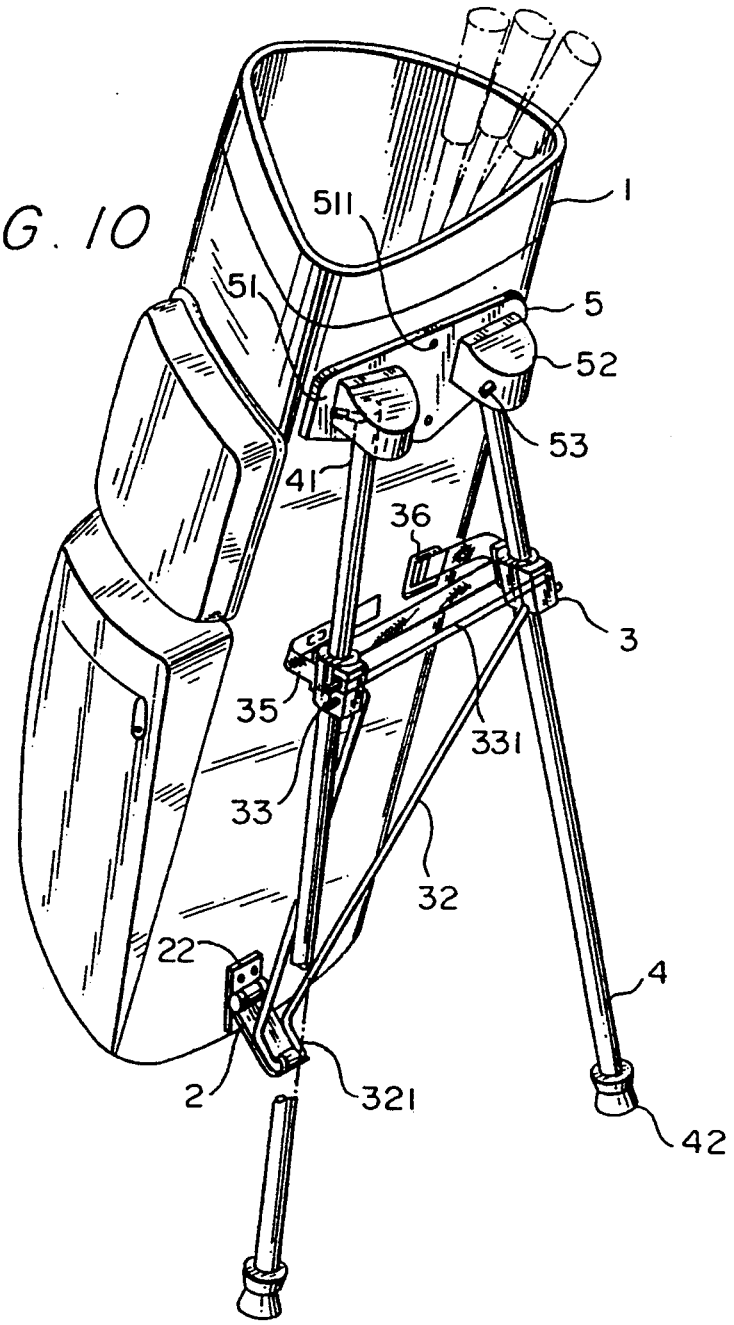
FIG. 10 is a perspective oblique view taken of FIG. 8.

Referring to FIGS. 8, 9 and 10, as the golf bag 1 is obliquely placed on the ground with the hinged movable plate 21 pressed against the ground, the hinged movable plate 21 is forced to push the spring link 32 upwards, causing it to extend the legs 4 bilaterally outwards along the X and Y axes. Therefore, the golf bag 1 becomes supported on the ground in a sloping position by the two legs 4 and the hinged device 2. Because the legs 4 and the hinged device 2 are supported on the ground at the three angles of a triangle, the golf bag 1 is stably supported in the sloping position. On the contrary, as the golf bag 1 is lifted from the ground, the spring link 32 automatically pushes the hinged movable plate 21 downward, and therefore the legs 4 are received back to the golf bag 1 automatically.

As indicated in FIGS. 3 and 3A, the two connectors 3 are respective fastened around the legs 4 and connected by the elastic band 331. The arrangement of the elastic band 331 holds the legs 4 together and allows the legs 4 to be extended outward from each other within a limited range. Further, the arrangement of the strap 35 secures the legs 4 to the golf bag 1 and allows the legs 4 to be extended outward from the golf bag 1 within an adjustably limited range.

What is claimed is:

1. A golf bag stand comprising:

a mount fastened to a golf bag on the outside at a higher elevation, said mount having two spaced sockets, each socket having an opening at the bottom;

a hinge device consisted of a mounting plate fastened to said golf bag at vertically spaced from said mount at a lower elevation, and a movable plate having one end hinged to the mounting plate of said mount and an opposite end terminated to a hooked portion;

two legs each having a top end respectively and pivotably fastened to either socket and a bottom end covered with a cushion for supporting said golf bag on the ground; and a positioning device for holding said legs in a supporting position to support said golf bag on the ground in a sloping position or in a collapsed position for allowing said legs to be closely attached to said golf bag, said positioning device comprising two connectors respectively mounted around said legs spaced below said mount, a spring link connected between said connectors and the hooked portion of said movable plate of said hinge device, a strap connected between said golf bag and said connectors to define the moving range of said legs from said golf bag, and an elastic loop fastened between said connectors to define the moving range between said legs.

2. The golf bag stand according to claim 1 wherein said spring link pushes said movable plate of said hinge device downward for allowing said legs to be automatically received to said golf bag as said golf bag is lifted from the ground; said movable plate of said hinge device is forced to push said spring link upward, as said golf bag is placed on the ground with said movable plate stopped against the ground, causing said spring link to extend said legs apart from each other and simultaneously to push said legs away from said golf bag.

3. The golf bag stand according to claim 1 wherein said mount and said hinge device can be alternatively fastened to said golf bag by rivets or screws.

4. The golf bag stand according to claim 1 wherein said spring link is made from a spring wire bent into a substantially V-shaped configuration, having a bent in the middle hooked by said hooked portion of said movable plate of said hinge device and two opposite ends respectively bent outward and inserted in a respective through hole on either connector.

5. The golf bag stand according to claim 1 wherein each socket comprises a guide track on the inside, which receives the top end of either leg for allowing the top end of the respective leg to be oscillated along the Y-axis, and pivot pin inserted in a bevel through hole thereof onto which the top end of the respective leg pivoted, said bevel through hole allowing the top end of the respective leg to be oscillated along the X-axis.

* * * * *